United States Patent [19]

Williams

[11] Patent Number: 4,798,342

[45] Date of Patent: Jan. 17, 1989

[54] FUEL PROCESSING SYSTEM FOR CONTROL OF NITROUS OXIDE EMISSIONS

[75] Inventor: Robert M. Williams, Ladue, Mo.

[73] Assignee: Williams Patent Crusher and Pulverizer Company, St. Louis, Mo.

[21] Appl. No.: 141,831

[22] Filed: Jan. 11, 1988

[51] Int. Cl.[4] ..... B02C 23/34

[52] U.S. Cl. ..... 241/18; 241/23; 241/48; 241/65; 241/119; 110/106; 110/232; 110/347

[58] Field of Search ..... 110/244, 232, 347, 106; 241/57, 58, 119, 30, 23, 18, 48, 52, 53, 65

[56] References Cited

U.S. PATENT DOCUMENTS

| | | | |
|---|---|---|---|
| 1,135,594 | 4/1915 | Liggett | 241/48 |
| 1,576,335 | 3/1926 | Kreisinger | 241/48 X |
| 2,427,903 | 9/1947 | Crites | 241/48 X |
| 2,960,324 | 11/1960 | Culp | 241/48 X |
| 4,582,260 | 4/1986 | Folsberg | 241/119 X |

*Primary Examiner*—Mark Rosenbaum

*Attorney, Agent, or Firm*—Gravely, Lieder & Woodruff

[57] ABSTRACT

The apparatus operates to supply the air requirements for grinding a fuel material to the mill to guarantee the correct particle size and to decouple from the air emitted from the grinding apparatus a certain proportion so the combustion of the ground fuel material will be conducted at a ratio of less than the usual 3 to 1 ratio of air-to-fuel so the combustion can be controlled to reduce the nitrous oxide emission, the air that is decoupled is returned to the grinding apparatus with a supply of make up air that is heated for purposes of drying the material in the grinding apparatus.

12 Claims, 2 Drawing Sheets

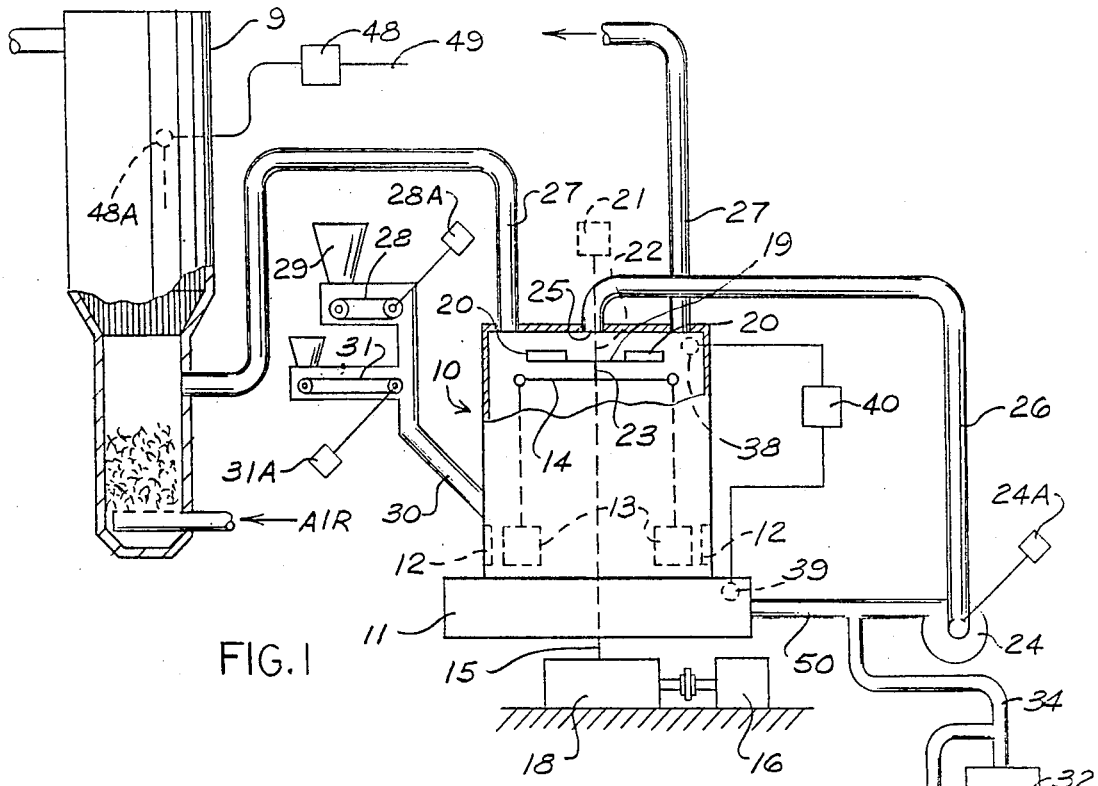
FIG. 1
FIG. 1A
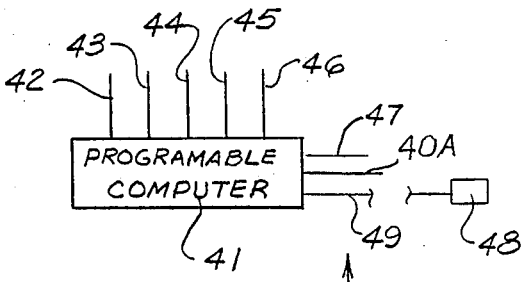
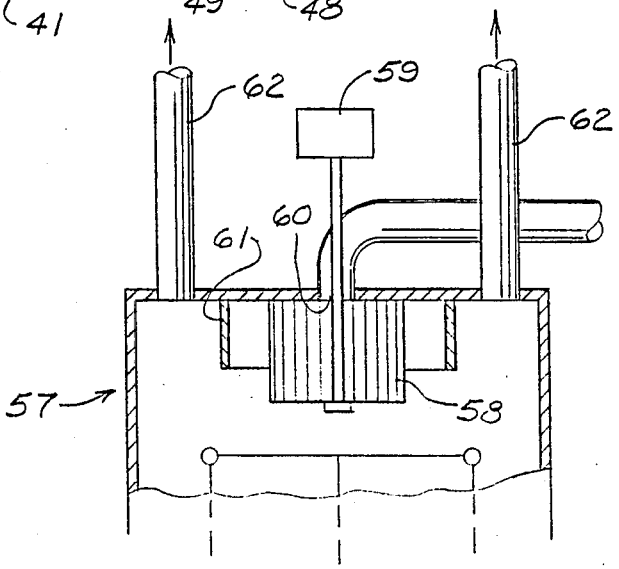
FIG. 2

FUEL PROCESSING SYSTEM FOR CONTROL OF NITROUS OXIDE EMISSIONS

BACKGROUND OF THE INVENTION

1. Field of the Invention

This invention relates to a roller mill operating system for supplying fuel to a burner to control the emission of nitrous oxide.

2. Description of the Prior Art

In boiler applications for burning of pulverized coal a standard has been developed to limit, if not eliminate, the emission of nitrous oxide into the atmosphere. The manufacturers of boilers must provide continuous monitoring systems that summate nitrous oxide emissions over a given period of time with the result that penalties can be assessed, or a plant can be shut down, if standards are not met.

Similarly the manufacturers of coal burning devices who supply such devices for use in boiler equipment are specifying that the coal must be ground to a particle size of 50 percent, minus 1000 microns all the way down to 70 percent, minus 74 microns, and the conveying air must be limited to an amount of substantially two pounds of air per pound of coal, or lower as that ratio of air to coal and coal size or fineness will enable the burner to meet the nitrous oxide standard. The manufacturers have stated that if coal is ground too fine, such as 80 percent, minus 74 microns, the combustion is so rapid that nitrous oxide is created, and if the coal is too coarse, the boiler has a problem of formation of slag.

Conventional coal pulverizers have a fixed area in the grinding chamber and a certain fixed air velocity is required to produce 70 percent, minus 74 micron coal particle size, and that air velocity is about 1100 F/M through the grinding zone. The quantity of air required for such a system is the product of velocity times open area which is a standard CFM that is used to size, dry, and convey the 70 percent, minus 74 micron particles out of the grinding system and into the boiler. From the above equation it is obvious that in a direct firing pulverizer system, the air leaving the system must go to the boiler, and that limits the ability to particularly match the grinding fineness to the air to obtain a 2:1 or optimum ratio of air to coal. This is particularly true when a boiler turndown is considered, as it is virtually impossible to maintain the air velocity through the grinding zone sufficiently high to produce a product of 70 percent, minus 74 microns and not exceed a 2:1 ratio of air to coal.

SUMMARY OF THE INVENTION

The purpose of this invention is to separate or decouple the air requirements for grinding the coal from the ar requirements for burner or boiler operation. This can be done allowing a portion of the air to be recycled back to the usual wind box of the roller mill in a closed loop. The recycle closed loop system allows the velocity through the fixed area of the roller mill interior to be maintained so as to guarantee the correct particle size. The correct air to coal ratio is obtained down stream from the recycle closed loop by allowing the proper quantity of air to enter the system and ultimately exit the system through the coal pipes with the coal.

The foregoing closed loop is established in several ways, and one is by incorporating a negative air system fan which processes the air to coal mix from the roller mill. The fan is used as a centrifuge device that centrifugally forces the coal particles to move to the outer surface in the fan housing. Air is removed from the bottom of the fan outlet away from the centrifugal coal particles, thereby causing a decoupling or separation of air and coal. This decoupling action in the fan outlet results in allowing up to one-half of the total air to be recycled to the roller mill wind box. The air drawn off may carry some fine particles which readily pass through the mill without further reduction.

The closed loop is provided with a control valve so that the amount of air to be decoupled and drawn into the loop can be controlled to assure that the air-to-coal ratio going to the burner will be correct for the most efficient operation of the burner, thereby limiting the nitrous oxide emission. The control means will permit varying the air-to-coal ratio for a turn down situation from high firing requirements down to low firing requirements.

An important object of the present invention is to construct a material grinding mill of rotary type with an internal arrangement of components that will allow the velocity of air in the grinding zone to be at about 1100 feet per minute, but thereafter to reduce the quantity of air that is used for transporting the ground material and to remove the excess air from the mill and recirculate it back to the mill. The result of this operation is to uncouple the air for transporting the ground material from the rest of the air which is recirculated in a closed loop so that there are two air flow systems, one for transportation of the material and one for recirculation.

Another object of the present invention is to construct a roller grinding mill with a air decoupling system that is either internal of the mill or external to the mill that will allow developing the required air velocity in the grinding zone for effective material grinding and that will decouple the air completely from the ground material so that the ground material is valved out of the system and can be mechanically transported to the burner system.

In all of the systems provision is made for the addition of an absorbent to control $SO_2$ emission, that absorbent being similar to limestone.

BRIEF DESCRIPTION OF THE DRAWINGS

The present invention is disclosed in several related embodiments having a common purpose, such embodiments appearing in the following views, wherein:

FIG. 1 is a first schematic embodiment of a roller mill for processing coal and limestone to a coarse particle size and recycling a portion of the air not used to transport the processed coarse particles.

FIG. 1A is an abbreviated block diagram of a programmable computer to be applied to the control of the system of FIG. 1;

FIG. 2 is a fragmentary diagram of a modified embodiment of a roller mill which has system characteristics common to the embodiment of FIG. 1;

DETAILED DESCRIPTION OF THE EMBODIMENTS

Figure 3:
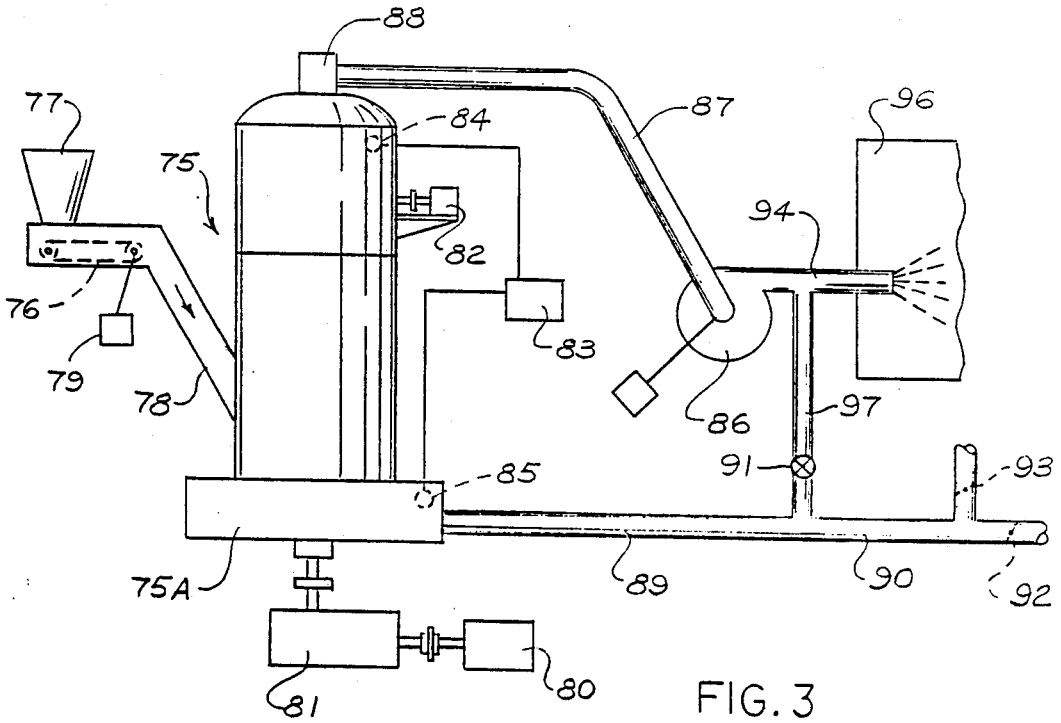
FIG. 3 is a third schematic embodiment of a roller mill which comprises characteristics that vary from the embodiments of FIGS. 1 and 2.

The schematic system seen in FIG. 1 embodies a roller mill assembly represented by the housing 10 having the usual air bustle or wind box 11 surrounding the grinding chamber represented by the bull ring 12 and centrifugally operated grinding rolls 13 mounted on a spider mechanism 14 connected to the vertical drive shaft 15. A drive motor 16 is connected through a combined speed controlled geared transmission 18, and that transmission is connected in the usual way to the drive shaft 15. The top space in the housing 10 above the spider mechanism 14 is occupied by a spinner separator mechanism comprising a rotary spider 19 supporting fan blades 20. The spider 19 may be rotated in several manners; for example, by a separate exterial motor 21 connected by a shaft 22 to the spider 19, or by an extension shaft 23 projecting from the mechanism 14 to the spider 19 and eliminating the external motor 21. It is not necessary to show both connections.

The roller mill wind box 11 receives a supply of air from the recirculating blower 24 through conduct 50, and that air after traveling through the grinding zone in the housing 10 be discharged partly at conduits 27 and partly at outlet 25 connected by conduit 26 to the recirculating blower 24. Other exits are seen at conduits 27 having outlet openings spaced around the perimeter of the top of housing 10. These conduits 27 connect at different locations of a circulating fluidized bed combustors 9 or to the burners in one or more furnaces (not shown).

The system of FIG. 1 includes means for drying the material being ground in the mill. A heater 32 using steam, gas or oil, receives air from a primary blower 33 and delivers the air to the conduit 34 through the heater 32 or through a by-pass conduit 35 for tempering the air. Valves 36 and 37 in the piping are intended to be adjusted so that the air in conduit 34 is at about 900° F. as it enters the delivery conduit 50 and combines with recirculating air from conduit 26 so that the temperature of the air entering the wind box 11 is at about 400° F. The operation of the recirculating blower 24 is such that the velocity of the air in the roller grinding chamber is at about 2000 feet per minute (F/M), and the material being processed in the mill is centrifuged by the spider mechanism 19 and the fan blades 20 so that the coarse material is flung out to the periphery of the housing 27 after the grinding by rollers 13, while it is possible that some of the very fine particles are carried out at the exit 25 and pass around to the recirculating blower 24 and back to the mill.

The system of FIG. 1 operates so that approximately one-half of the air supplied by the recirculating blower 24 is withdrawn from the mill at the exit 25 and decoupled from the coal transport air. Thus, the remainder of the air is applied to transport the ground material in conduits 27 in a ratio of about one pound of air to one pound of ground material (a ratio of 1 air per 1 lb. of material). The mill speed may vary from about 70 RPM to 100 RPM, and the pressure across the mill is the equivalent of about 4" of water column as detected by pressure sensor 38 in the top of the housing 10 and a sensor 39 in the wind box 11. The pressure sensors 38 and 39 are connected into a differential pressure measuring device 40.

The spinner separator 19 with its fan elements 20 during rotation prevents the coarse material from entering the outlet 25, thereby assuring that only the extreme fines will pass with the air to the conduit 26 and return to the recirculating blower 24 to be mixed with the hot drying air from the conduit 34. As noted, the heater 32 receives its air from the primary air blower 33.

The coal and limestone material to be ground and mixed together is delivered by a coal conveyor 28 from a collection bin 29 into the feed chute 30 that opens into the side of the housing 10 in the vicinity of the grinding chamber. Limestone is delivered by a suitable conveyor 31 into the chute 30 at a suitable inlet in the chute 30. The system of FIG. 1 grinds the coal and limestone to a closely held coarse size of 50 percent, minus 500 micron a (D 50 of 500 micron). The size is critical to promote decrepitation and prevent loss of carbon in the ash from a circulating fluidized bed combustor.

The system of FIG. 1 is under the control of a programmable computer 41 that is adapted to coordinate the functions of the system. It is believed understandable to merely indicate that the computer has leads to be connected to the devices capable of being controlled, or capable of generating a sensitivity to what needs to be done. For example, lead 42 may be connected to the coal feeding conveyor motor 28A. Lead 43 may be connected to the limestone feeding conveyor motor 31A. Lead 44 may be connected to the mill driving motor 16. A lead 45 may be connected to the recirculating blower drive motor 24A, and a second lead 46 may be connected to the primary blower drive motor 33A. The valves 36 and 37 are adapted to proportion the air into or in by-pass of the heater 32 and a common connection may be made at lead 47 into the computer 41. The condition of the quantity of material in the grinding chamber is monitored by the differential pressure measuring device 40 which is connected into the computer 41 at lead 40A. The programmable computer 41 receives a signal from a demand sensor 48 by lead 49, and that signal determines the overall operating reactions of the various motors 28A and 31A feeding material into the mill 10, the speed of motor 16 which causes the rollers 13 to grind faster or slower to meet the demand, and to adjust the blower for providing the drying of the material and the proportion of the volume of the air that is decoupled and recirculated. These control functions are developed by the computer 41 in which feed forward differentiation and summing are included with linearizing operations. Further, the computer 41 will operate to select new set points as required. The demand sensor 48 is disposed in a position to sense whether the coal is delivering the necessary heat output. The system, therefore, controls the build up of material in the mill, checks the combustor and regulate the blower 24 so as to determine the particle size, capacity of the mill and air/coal ratio and supply multiple outlets.

A modified and fragmentary system is disclosed in FIG. 2, which will not repeat the controls seen in FIG. 1 as those are the same. The modified roller mill assembly 51 is seen to embody only so much of the components as will adequately present the invention. The upper space of the housing assembly 51 is occupied by a basket device 58 for classifying the material following grinding. Such a basket device is disclosed in FIG. 4 of U.S. Pat. No. 4,257,880. The basket device 58 is rotated by an externally positioned motor means 59 located above an air outlet conduit 60. An annular baffle ring 61 surrounds the basket 58 to exclude larger particles of material in the circumferential area of the housing for movement into the outlet conduit 62. In other respects what is shown in FIG. 2 has all of the parts and elements and their functions for FIG. 1, and need not be repeated again.

It is understood that the basket means 58 is rotated so as to exclude the coarse material and to allow passage of a portion of the air and some micron size particles.

The embodiment disclosed in the schematic view of FIG. 3 includes a conventional roller mill and spinner separator assembly 75 of the type seen in my prior U.S. Pat. No. 4,602,744. The coal is supplied by a conveyor 76 from a bin 77 into the feed chute 78. The conveyor 76 is operated by a motor 79, the roller grinding means in the assembly is operated by a motor 80 driving through a transmission 81, while the spinner separator mechanism is operated by motor means 82. The pressure condition across the assembly 75 is monitored by a manometer device 83 connected to a pressure sensor 84 in the top of the spinner separator portion of the assembly 75 and a second pressure sensor 85 in the wind box 75A for the assembly 75.

In operation, a blower 86 has its inlet connected by conduit 87 to the top outlet 88 of the assembly 75. Air is admitted to the wind box by a conduit 89 through an inlet conduit 90 connected to a source of hot drying air at the inlet 92. Tempering air is supplied at a branch conduit 93 opening to the conduit 91.

The system of FIG. 3 differs from the prior art in the respects that while the blower has its outlet 94 directed to deliver air and ground coal directly to a burner 95 (schematically shown) in the boiler 96, the outlet 94 has a lateral conduit 97 opening from a side of the outlet 94 adjacent the blower where the ground material is forced to follow the upper side of conduit outlet 94 and air almost free of ground material is readily drawn off. The conduit 97 is connected into the valve 91 where the air can be aspirated or blown into conduit 89 for recirculation along with the hot drying air. The uniqueness of this system is that the grinding of the coal can take place in the chamber where the air velocity is 1100 feet per minute so the particle size (70 percent, minus 74 microns) can be most easily controlled. Thereafter, the outgoing product is transported by air in about the ratio of 3 lbs. of air to 1 lb. of coal, but the particle size is such that it burns too fast or the flame is blown away from the burner nozzle. The result is that nitrous oxide is produced and is emitted in the boiler stack.

However, by controlling the particle size of the coal to be as coarse as explained above, and by drawing off a portion of the air at the conduit 97, the delivery to the burner can be at a 2:1 ratio of air to coal, or at a 1:1 ratio of air to coal, as desired, thereby controlling nitrous oxide emissions.

Figure 4:
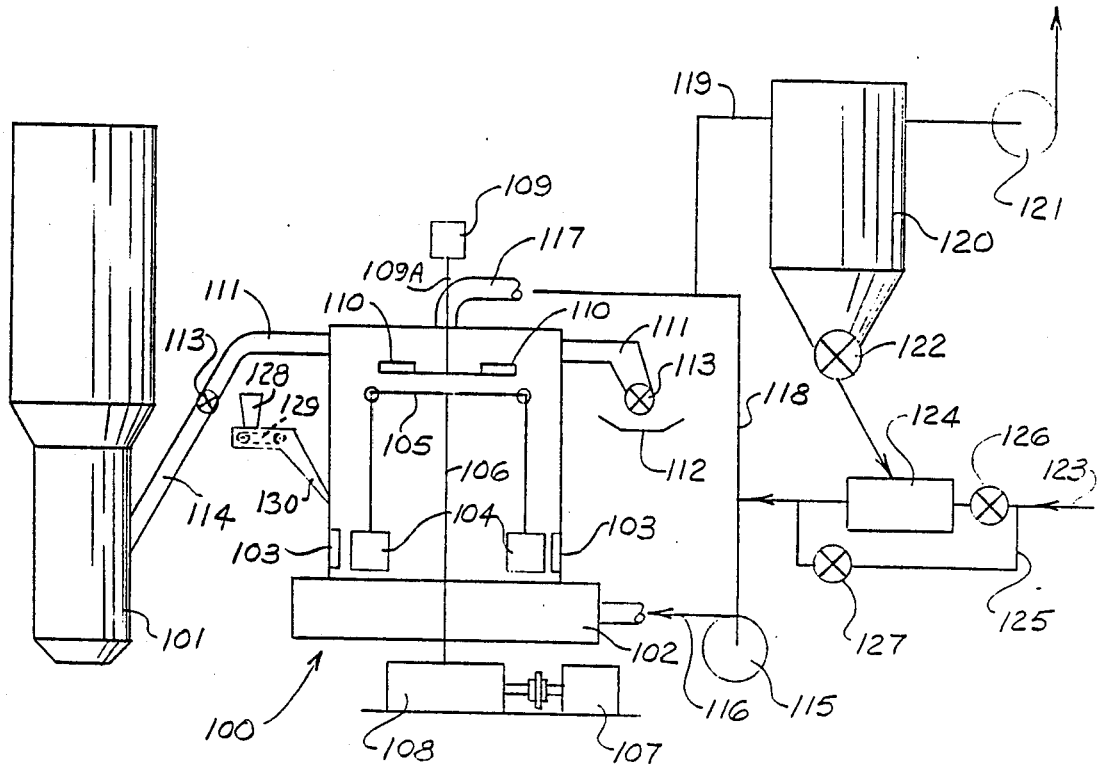
FIG. 4 is a further schematic embodiment of a system for grinding coal in a roller mill and delivering the ground product at ambient conditions while recirculating the air independently of the delivery of the ground product.

The embodiment of FIG. 4 comprises a centrifugally driven roller mill grinder 100 for reducing coal to be supplied to a circulating fluidized combustor 101. In this case the mill 100 has the usual wind box 102 adjacent the grinding chamber or area in the housing. The usual bull ring 103 and cooperating rollers 104 are disposed in that area, and the rollers are suspended from a spider mechanism 105 rotated by a central shaft 106 driven by motor 107 connected to the shaft 106 through a suitable transmission 108. An external motor 109 rotates blade members 110 for centrifugally propelling the coarse material through the outlet conduits 111 for release to suitable belt conveyors 112. Each outlet conduits 111 are provided with rotary gate means 113 to control the ground product release from the system. The conduit 111 at the left of the mill 100 is released through a rotary gate means 113 into a feed conduit 114 directly to the fluid bed combustor 101. The conveyor 112 moves the product without use of air.

The source of air for drying and releasing the coal material is a blower 115 which delivers the air through conduit 116 to the wind box 102, and the air flow at the outlet duct 117 is directed through conduit 118 back to the blower 115. Some of the air is drawn into a branch conduit 119 to a bag house 120 and is expelled to atmosphere by a blower 121. The fine particulate matter collected in the bag house 120 is released through the rotary valve 122 and is directed selectively (see dash lines) either to the conveyor 112, or to the return conduit 116, or to a heater as the fuel for heating inlet air for drying. The inlet air is at conduit 123 and the heater 124 has a tempering air-by-pass conduit 125. The by-pass is effective by controlling valves 126 and 127.

It should now be apparent from the foregoing disclosure that the apparatus is arranged to decouple a portion of the air supplied to the roller mill for moving the pulverized fuel material, or coal, so the remaining air can be applied to continue moving the material or coal after being pulverized. The coal is supplied from a bin source 128, and feed conveyor 129 to the chute 130. The decoupled air is recirculated to the roller mill. The function of decoupling air is to provide a ratio of air to fuel at less than the 3 to 1 ratio currently in vogue. The reduction in the ratio is easily achieved by the present apparatus at a considerable cost saving in that equipment can be reduced in number and size.

The achievement in reduction of the ratio of air to fuel is accomplished either internally of the roller mill itself, or externally when the roller mill is not modified from the current standards.

The system described above may be summarized as having means in the coal processing system for transporting the pulverized coal to a burner and in such system, decoupling a portion of the air from the air that is used to move the pulverized coal to the burner to provide an air-to-coal ratio that is substantially correct for limiting the nitrous oxide emission. As explained, this result can be achieve in the ways shown in FIGS. 1 or 3 in its broadcast sense.

What is claimed is:

1. In a system for processing cola in a roller mill grinding zone to pulverize the coal as a fuel for use in a burner, and for controlling the emission of nitrous oxide on combustion of processed coal, the improvement comprising:

(a) means supplying coal to the roller mill for pulverizing the coal therein;

(b) means for supplying air into the roller mill for sizing and moving the pulverized coal; and (c) means in the coal processing system for transporting the pulverized coal to the burner and simultaneously decoupling a portion of the air moving the pulverized coal, whereby the air-to-coal ratio going to the burner is substantially correct for limiting the nitrous oxide emission.

2. The improvement set forth in claim 1 wherein said means in the coal processing system to limit the nitrous oxide emission is a fan casing having an inlet for air transported pulverized coal, and means to recycle the portion of the decoupled air back to the means to supply air to the roller mill.

3. The improvement set forth in claim 1 wherein said means in the coal processing system to limit the nitrous oxide emission is rotationally operative internally of the roller mill.

4. The improvement set forth in claim 1 wherein said means in the coal processing system to limit the nitrous oxide emission is operative externally of the roller mill.

5. The improvement set forth in claim 1 wherein heat supplying means is connected into said means for supplying air into said roller mill for drying the coal in the roller mill.

6. The improvement set forth in claim 1 wherein limestone is supplied with the means for supplying the coal.

7. In a system for processing coal in a coal pulverizing mill for use in a burner and for controlling the emission of nitrous oxide or combustion of the processed coal in the burner, the improvement comprising:

(a) air moving means connected in a closed circuit loop across the coal pulverizing mill;

(b) an outlet connected into said closed loop, said outlet being connected to the burner;

(c) coal feeding means connected to the pulverizing mill introducing coal into the coal processing system and into the closed circuit; and (d) air moving fan means positioned in said closed loop adjacent said outlet connection, said air moving means being oriented to divert a portion of the air out of said outlet connection and moving in said closed loop whereby the ratio of air-to-pulverized coal delivered through said outlet connection to the burner is substantially correct for limiting nitrous oxide emission.

8. A method of processing fuel material in a pulverizing mill associated with a fuel burner and controlling the combustion of the fuel for limiting the nitrous oxide emission, said method comprising:

(a) providing the pulverizing mill with a source of fuel material;

(b) creating a conduit loop containing the pulverizing mill acting as a path for air through the loop;

(c) inserting an air moving means in the conduit loop for moving air through the pulverizing mill contained therein;

(d) forming an air inlet to the conduit loop;

(e) delivering pulverized fuel to the burner from the conduit loop, while decoupling from the air moving in the conduit loop, a portion of air for limiting the air-to-fuel ratio delivered to the burner to substantially correct for nitrous oxide emissions.

9. The method of claim 8 and including adding heat to the air moving in the conduit loop for drying the fuel material during the pulverizing of that fuel material.

10. The method of claim 8 and including effecting the decoupling of the portion of the air moving in the conduit loop internally of the pulverizing mill.

11. The method of claim 8 and including effecting the decoupling of the portion of the air externally of the pulverizing mill.

12. The method of claim 8 and including the providing of limestone with the providing of the fuel material to the pulverizing mill.

* * * * *